US007287880B2

(12) United States Patent
Beaumont

(10) Patent No.: US 7,287,880 B2
(45) **Date of Patent: *Oct. 30, 2007**

(54) BULB COOLING

(75) Inventor: Matt Beaumont, Ipswich (GB)

(73) Assignee: Production Resource Group, L.L.C., New Windsor, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/674,082

(22) Filed: Feb. 12, 2007

(65) Prior Publication Data

US 2007/0127246 A1 Jun. 7, 2007

Related U.S. Application Data

(60) Continuation of application No. 10/389,466, filed on Mar. 13, 2003, now Pat. No. 7,175,317, which is a division of application No. 09/778,991, filed on Feb. 1, 2001, now Pat. No. 6,578,991.

(60) Provisional application No. 60/179,981, filed on Feb. 3, 2000.

(51) Int. Cl.
*F29V 29/02* (2006.01)

(52) U.S. Cl. ..... 362/345; 362/264; 362/547; 362/294; 362/218

(58) Field of Classification Search ..... 362/264, 362/547–548, 294, 218, 345, 373; 313/33, 313/35, 46

See application file for complete search history.

(56) References Cited

U.S. PATENT DOCUMENTS

| | | | |
|---|---|---|---|
| 3,626,176 | A | 12/1971 | Tsugami |
| 4,630,182 | A | 12/1986 | Moroi et al. |
| 5,372,781 | A | 12/1994 | Hallett et al. |
| 5,621,267 | A | 4/1997 | Shaffner et al. |
| 5,746,495 | A | 5/1998 | Klamm |
| 5,947,592 | A | 9/1999 | Barlow |
| 6,095,671 | A | 8/2000 | Hutain |
| 6,402,346 | B1 | 6/2002 | Liao et al. |

*Primary Examiner*—Laura Tso
(74) *Attorney, Agent, or Firm*—Fish & Richardson P.C.

(57) ABSTRACT

A system and method of cooling a bulb of a type that requires cooling in one part, but not in others. A deflector assembly is coupled through a reflector, to the bulb, to cool only one part.

20 Claims, 6 Drawing Sheets

BULB COOLING

CROSS-REFERENCE TO RELATED APPLICATIONS

This application is a continuation application of and claims priority to U.S. application Ser. No. 10/389,466, filed on Mar. 13, 2003 now U.S. Pat. No. 7,175,317, which is a divisional application of and claims priority to U.S. application Ser. No. 09/778,991, filed on Feb. 1, 2001 now U.S. Pat. No. 6,578,991, which claims priority to U.S. Provisional Application 60/179,981, filed Feb. 3, 2000. The disclosure of the prior applications are considered part of (and are incorporated by reference in) the disclosure of this application.

BACKGROUND

The present application relates for special techniques for cooling a special kind of bulb.

Special metal halide bulbs have special cooling requirements. The bulbs, such as Philips metal halide projection lamps, often have a central portion which emits light, and two "pinch" portions around the central portion.

A diagram of an exemplary one of these bulbs is shown in FIG. 1. The bulb has a central light emitting portion 100, and the two surrounding "pinch" portions 102, 104.

In some bulbs, it is desirable to keep the pinch portions 102, 104 cooler than the center portion. This is easy to do in a laboratory condition, but more difficult to do in practice.

SUMMARY

While it may be possible easy to cool only an edge and not the center in a laboratory, the inventor recognized that doing this in practicality can be more difficult. For example, in a laboratory, the bulbs are often cooled using pipes of air. Those pipes could get in the way of the light output from the bulb, and/or the bulb's reflector. Therefore, it has been difficult to cool these kinds of bulbs.

The present application teaches a way of cooling a bulb of this type, by cooling only a pinch portion, and not the center portion. This is done by using a special combination of structure that cools at least one of the edges, but does not cool the center.

BRIEF DESCRIPTION OF THE DRAWINGS

These and other aspects will be described in detail with reference to the drawings in which.

DESCRIPTION OF THE PREFERRED EMBODIMENT

Figure 1:
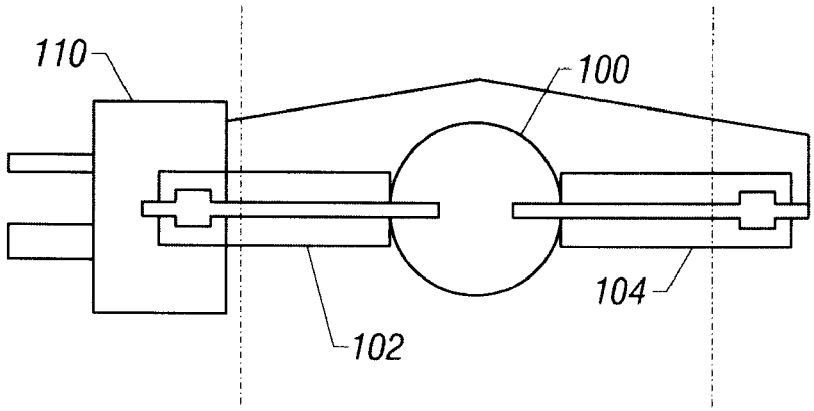
FIG. 1 shows a pinch-type bulb.

A bulb of the preferred type is shown in FIG. 1. This bulb has a central portion 100 which emits light, and edge portions 102, 104, at least one of which need to be cooled. The central portion 100, which emits the light, is preferably not cooled. The bulb used herein is called an MSR SA, or short arc discharge bulb. Other bulbs have similar cooling requirements.

Figure 2:
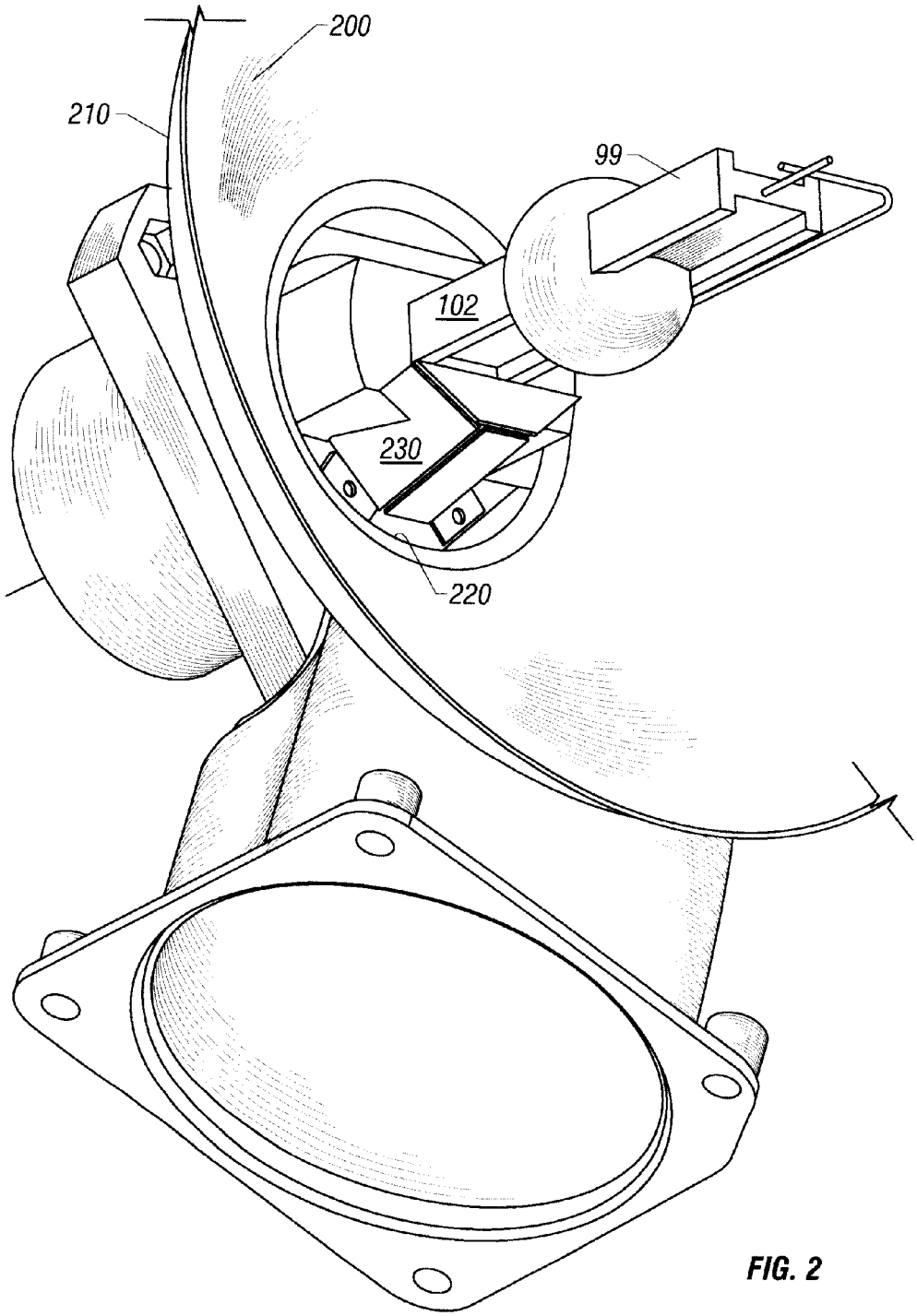
FIG. 2 shows the bulb relative to a portion of the reflector.

The edge portions 102, 104 should preferably be kept between 400 and 450° C. The bulb is mounted as shown in FIG. 2. When mounted in this way, the far edge portion 104 is often sufficiently cooled by ambient to be kept within the desired range. However, the near edge portion 102 gets very hot, due to the proximity to the ceramic base 110 and also because of its electrical connection. Also, as described above, cooling should not, or should only minimally, touch the center portion 100.

FIG. 2 shows the bulb 99 placed relative to a portion of the reflector 200. The base portion 110 of the bulb is shown connected. The reflector 200 includes an outer edge 210 and an inner edge 220. A metal air deflecting portion 230 fits within the inner edge 220, and directs air from a fan to the close pinch portion 102 of the bulb which is close to the reflector.

Figure 3:
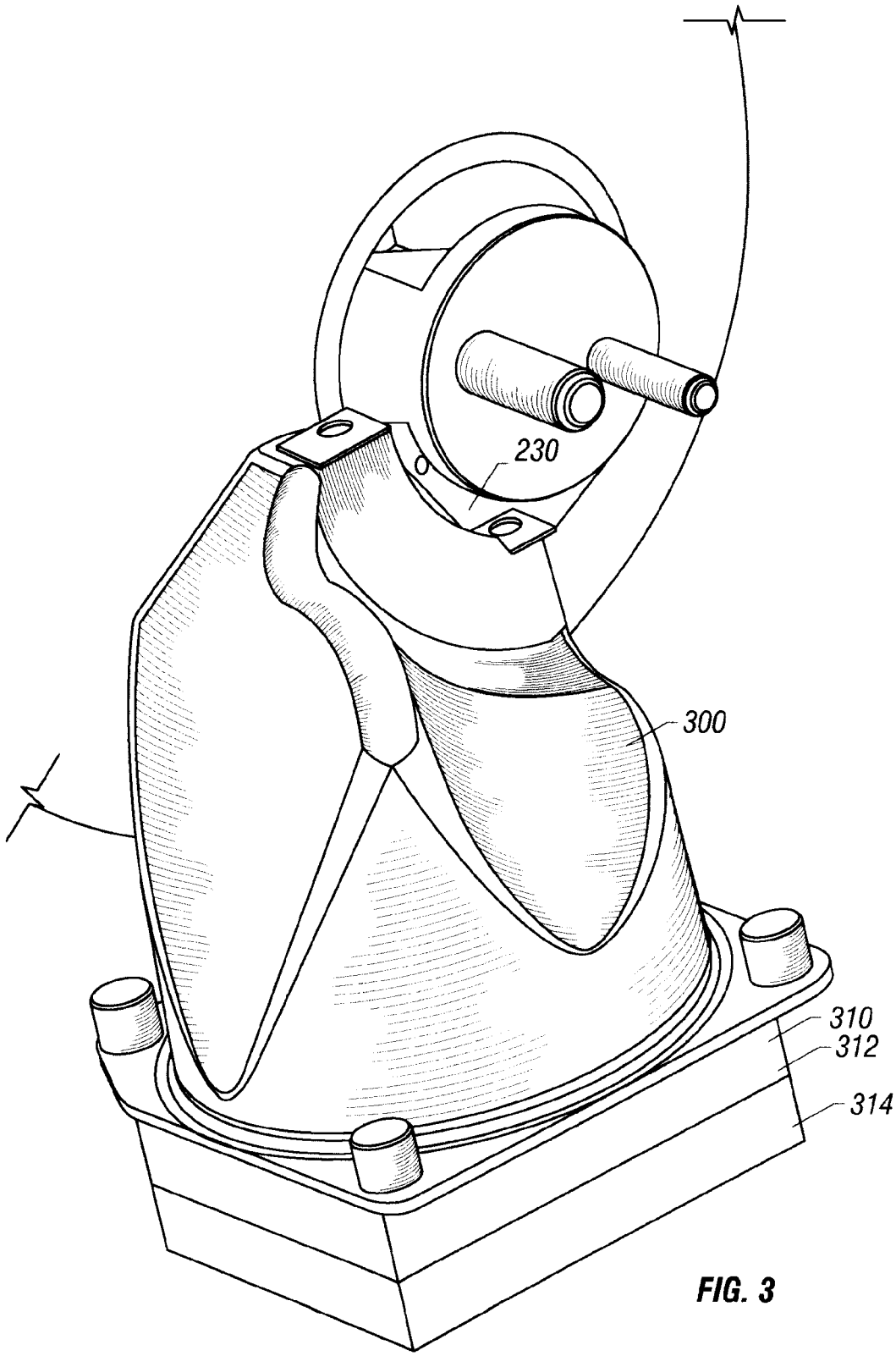
FIG. 3 shows the rear of the reflector and the fan assembly.

FIG. 3 shows the rear view of the system. An air chamber 300 is attached to a fan assembly shown generically as 310. The fan assembly 310 forces into the air assembly 300, and through the air coupling mechanisms 230, to eventually end up at the bulb. Further detail is shown in the other Figures.

Figure 5:
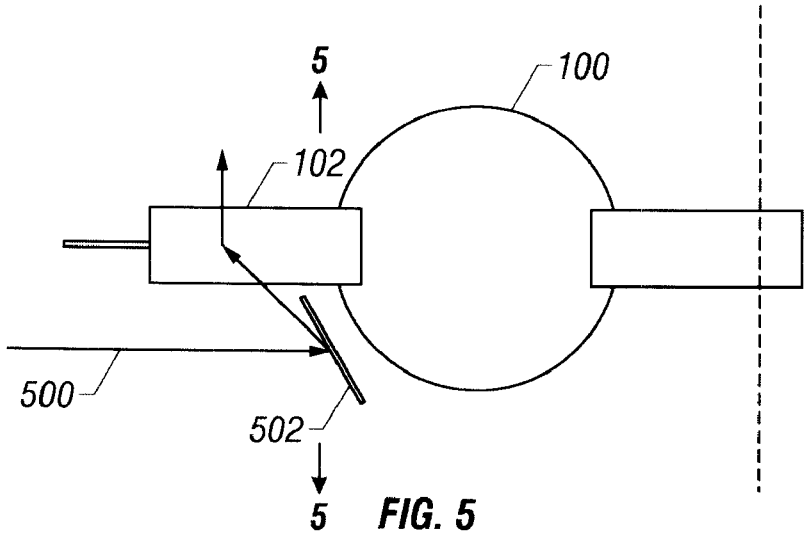
FIG. 5 shows air flow over the pinch, from the side.
Figure 4:
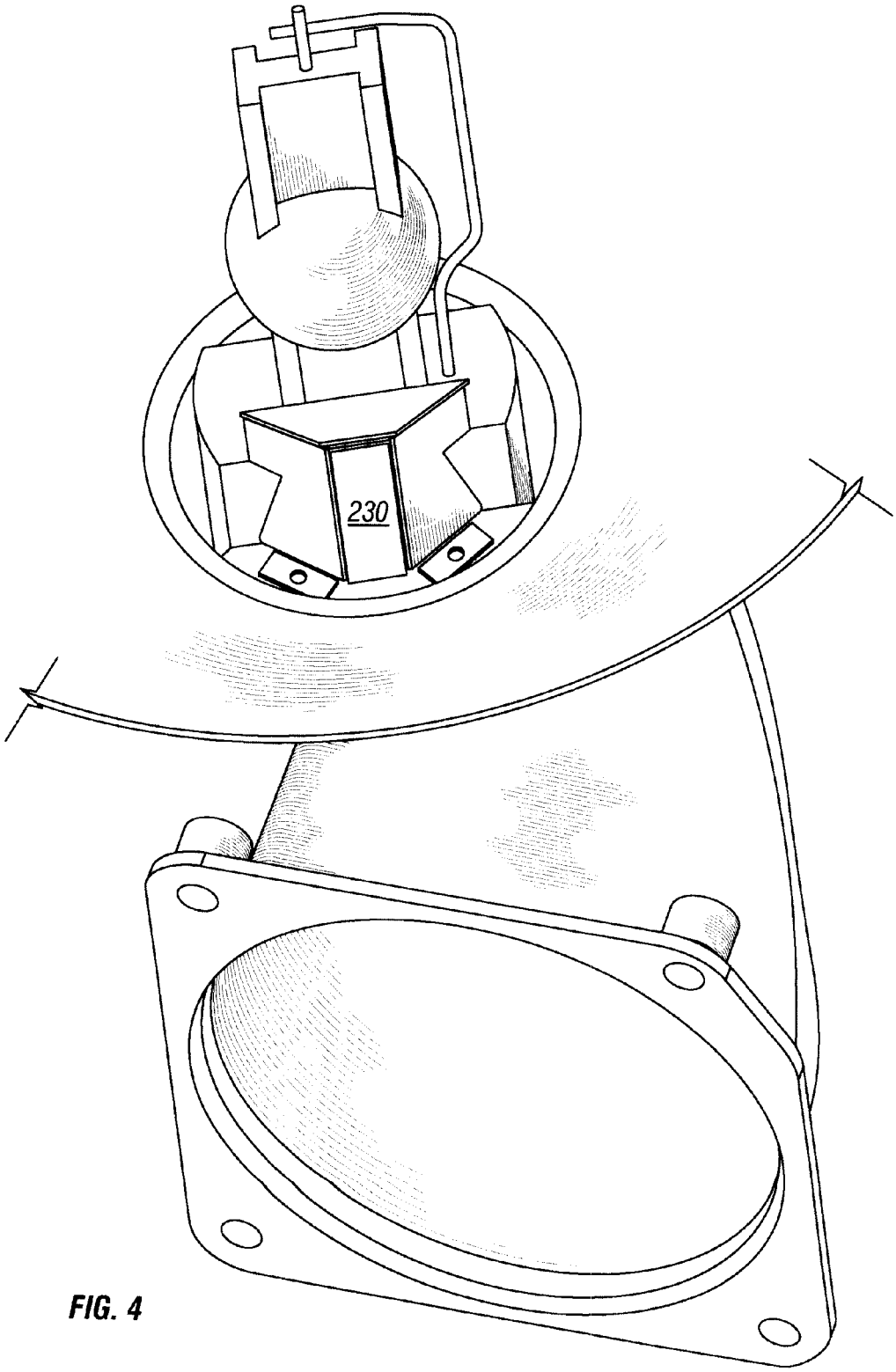
FIG. 4 show the bulb/reflector from the bottom, showing the special interface piece.

FIG. 4 shows more detail of the shape of the air deflection assembly. FIG. 5 shows schematically how the air is coupled. The air couples through the assembly as 500. It hits the far end wall 502 of the air coupling assembly 230. This air is then deflected back towards the near pinch 102, and travels thereover, cooling the near pinch 102 as it passes. The air is traveling away from the main portion of the bulb. In this system, the air preferably travels from the central portion towards the pinch.

Figure 6:
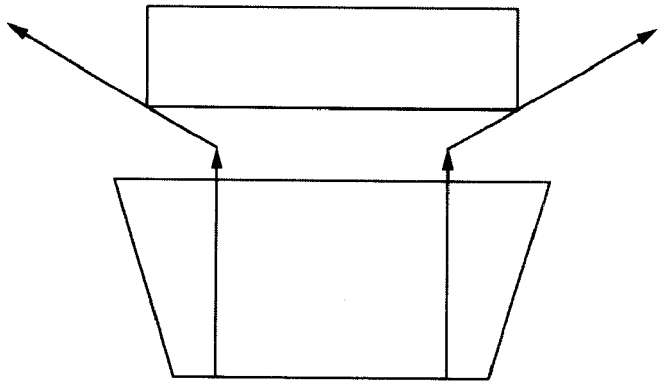
FIG. 6 shows air flow over the pinch from the orthogonal direction as FIG. 5.

FIG. 6 shows a cross-section along the line 5-5 in FIG. 5. The air travels outwardly, as shown, and hence again travels away from the pinch portion.

Figure 7:
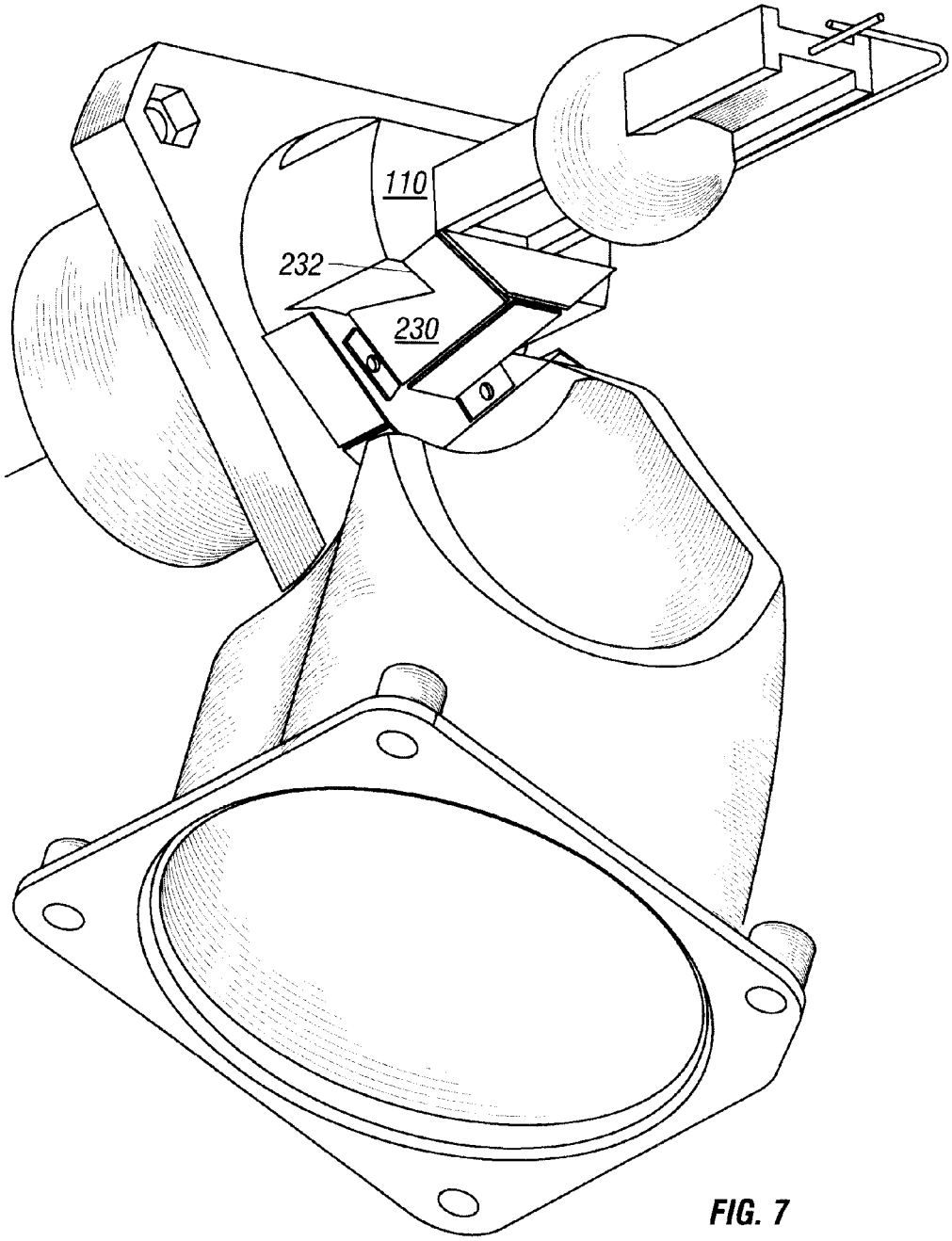
FIG. 7 shows the bulb with the reflector removed.

FIGS. 5 and 6 show the air chimney defined by the metal pieces 230. These pieces are aligned relative to the bulb. The alignment is shown in more detail in FIG. 7 which shows the air producing assembly 230, held in place relative to the bulb. The alignment can be via connection to the reflector in a way that holds the chimney relative to the desired cooled area of the bulb. It can be, alternatively, held by a clip that is placed around the bulb. The air producing assembly includes inner surfaces 232 which are adapted to press against the face 110, to hold the air deflection assembly in place relative to the bulb or the bulb's expected position.

Figure 8:
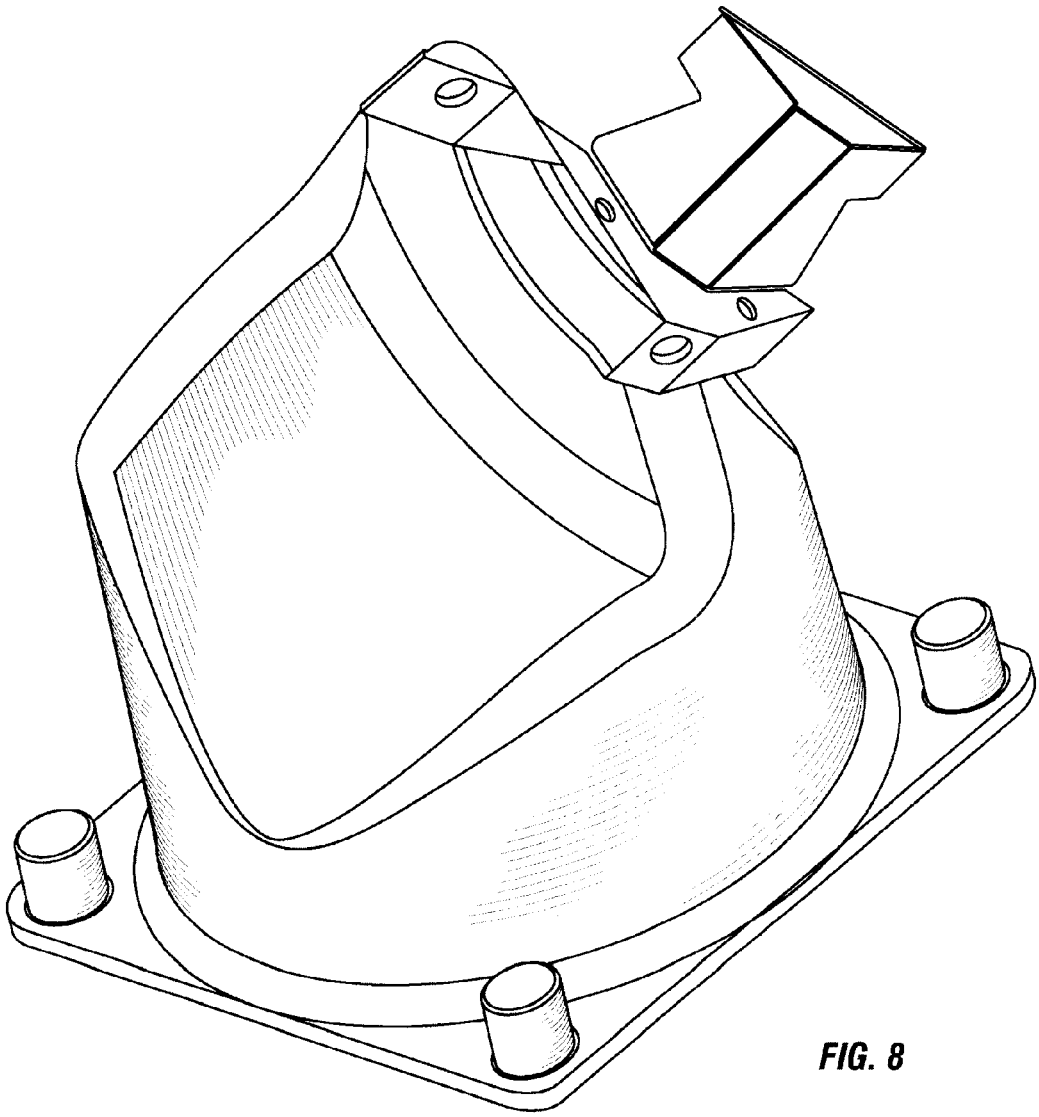
FIG. 8 shows the air interface assembly.

FIG. 8 shows a diagram of only the air producing assembly and the attachment to the air chimney. The fan assembly 310 comprises two separate fans mounted one on top of the other as shown. Fans 312 and 314 produce air at the same rate as one fan would have produced but at a higher air pressure.

Although only a few embodiments have been disclosed in detail, other embodiments are possible. All such modifications are intended to be encompassed within the following claims.

What is claimed is:

1. A lighting device, comprising:

a lighting reflector defining a reflection area within an inside surface of said lighting reflector;

a lighting socket, located in a location that is adapted to locate a light bulb, which light bulb is adapted to connect to said lighting socket, within said reflection area, said lighting socket including a first portion which connects to said light bulb, and a second connection portion that extends in a direction away from said lighting socket; and a structure defining a cooling area, operative to cool one portion of the bulb without cooling another portion of the bulb.

2. A lighting device as in claim 1, wherein said structure defining a cooling area comprises at least one deflection portion which deflects cooling air towards said first portion.

3. A lighting device as in claim 1, further comprising a fan that provides cooling air.

4. A lighting device as in claim 1, further comprising two separate fans that collectively provide cooling air.

5. A lighting device as in claim 4, wherein said two separate fans are located one directly on top of the other.

6. A lighting device as in claim 1, wherein said structure defining a cooling area comprises at least one air conduit with different directional connections for the air.

7. A device as in claim 1, wherein said structure defining a cooling area is aligned relative to the reflector.

8. A device as in claim 7, wherein said structure defining a cooling area includes a chimney that is coupled to the reflector.

9. A device as in claim 1, wherein said lighting socket is adapted for use with an elongated bulb which includes a first connection part at a first end of the bulb, a second connection part at a second opposite end of the bulb, and a lighting portion in between said first and second ends.

10. A lighting device, comprising:

a lighting reflector;

a lighting socket, having a first portion adapted to hold a first pinch of a lighting bulb, and a second portion that extends remotely from said first portion, and connects to an opposite end of the lighting bulb; and a cooling assembly, fixed in position relative to the said lighting reflector, and operate being to cool an area of said first pinch, without cooling portions of the bulb other than said first pinch.

11. A device as in claim 10, wherein said cooling assembly includes a fan, and at least one structure defining a cooling conduit for the fan.

12. The device as in claim 10, wherein said cooling assembly includes two fans, located one directly on top of the other and one blowing through the other.

13. The device as in claim 11, wherein said cooling conduit includes a chimney structure that is fixed relative to said lighting reflector.

14. The device as in claim 13, wherein said chimney structure includes a first part that directs air away from said opposite end.

15. The device as in claim 10, further comprising a light bulb, coupled to said light socket, said light bulb including ceramic portions near said first pinch and said opposite end.

16. A lighting device, comprising:

lighting components including a lighting reflector;

a lighting socket, having parts that are adapted to hold a light bulb; and a cooling portion for at least one of said lighting components, said cooling portion including a first fan and a second fan, mounted one directly over the other, and pumping air in series, to cool said lighting components.

17. A lighting device as in claim 16, wherein said cooling portion further includes an air chimney, directing air to at least one portion of one of said lighting components.

18. A lighting device as in claim 16, wherein said cooling portion cools an area of the light bulb, without cooling a different area of the light bulb.

19. A lighting device as in claim 18, wherein said cooling portion includes at least one air conduit, receiving air from said first fan and said second fan.

20. A lighting device as in claim 18, wherein said air conduit is an air chimney, that includes air therein.

* * * * *